US005730341A

United States Patent [19]

Hester, Jr.

[11] Patent Number: 5,730,341

[45] Date of Patent: Mar. 24, 1998

[54] SLING ASSEMBLY FOR A COMPOUND BOW

[76] Inventor: Tony Lamar Hester, Jr., 4183 Rattler Rd., Acworth, Ga. 30102

[21] Appl. No.: 764,671

[22] Filed: Dec. 11, 1996

Related U.S. Application Data

[63] Continuation-in-part of Ser. No. 657,376, Jun. 3, 1996.

[51] Int. Cl.[6] ..... A45F 3/14

[52] U.S. Cl. ..... 224/257; 224/916; 224/150; 224/614; 124/88; 24/302; 24/702

[58] Field of Search ..... 224/149, 150, 224/578, 579, 580, 614–622, 627, 628, 629, 633, 257, 258, 271, 272, 913, 916, 610, 611, 612; 24/302, 690.2, 702; 124/23.1, 86, 88

[56] References Cited

U.S. PATENT DOCUMENTS

| | | | |
|---|---|---|---|
| 384,736 | 6/1888 | Bedford | 224/614 |
| 1,427,728 | 8/1922 | Fairless | 224/616 |
| 2,102,964 | 12/1937 | Mossberg | 224/150 |
| 2,446,197 | 8/1948 | Sloan | 224/150 |
| 2,679,960 | 6/1954 | Lowe | 224/616 |
| 2,885,812 | 5/1959 | Arpin | 224/150 |
| 3,351,971 | 11/1967 | Engh | 224/614 |
| 3,688,012 | 8/1972 | Vettel | 224/271 |
| 3,998,367 | 12/1976 | Harding | 224/916 |
| 4,116,310 | 9/1978 | Shields | 224/616 |
| 4,271,999 | 6/1981 | Stravitz | 224/271 |
| 4,754,904 | 7/1988 | Fischer et al. | 224/259 |
| 4,966,319 | 10/1990 | Fleming | 224/615 |
| 5,110,022 | 5/1992 | Dvoroznak et al. | 224/150 |

*Primary Examiner*—Henry J. Recla
*Assistant Examiner*—Gregory M. Vidovich
*Attorney, Agent, or Firm*—Harry I. Leon; Vivian L. Steadman

[57] ABSTRACT

A sling assembly for hands free carrying of a compound archery bow. Weight adjustment screws, components of a conventional bow, are employed to attach the sling assembly thereto without structurally modifying it. However, once the sling assembly has been so attached, the bow must be retensioned prior to use. Included in the sling assembly are two small brackets which are mirror images of each other and have first and second arms set at an obtuse angle to each other. Each bracket defines a pair of longitudinally extending prongs which can be slid into position around a weight adjustment screw without actually removing it from the bow. The sling assembly also includes a flexible strap secured to the brackets with the use of elongated slots formed in each of them. In use, the brackets are mounted on a bow in such a way that the elongated slots are disposed close to the bow. The sling is held out of the way when the bow is fired, being disposed either to the right or to the left of the bow handle, depending upon the orientation of the brackets.

3 Claims, 6 Drawing Sheets

SLING ASSEMBLY FOR A COMPOUND BOW

CROSS-REFERENCE TO RELATED APPLICATION

This application is a continuation-in-part of my earlier copending application Ser. No. 08/657,376, filed Jun. 3, 1996.

BACKGROUND OF THE INVENTION

This invention relates to a sling assembly for a compound bow used by archers. More particularly, it relates to such an assembly in which the sling can be easily attached to the bow structure without modifying it.

Bow slings which can be removably fastened to a compound bow are known in the prior art. Hughes, in U.S. Pat. No. 4,760,944, which issued on Aug. 2, 1988, discloses such a sling. Hughes' sling includes a pair of mounting members formed of wrap around fabric to which are attached hook and loop type (VELCRO) fasteners. The mounting members are secured to the bow at each of two junctures which are located thereon between one of its limbs and its riser or handle. With the hook and loop type fasteners, the mounting members can be secured to the bow without modifying it. Prior to the bow's being used, however, Hughes' sling must be removed; otherwise, it would interfere with the operation of the bow.

Specht, in U.S. Pat. No. 5,239,976, which issued Aug. 31, 1993, discloses a sling connected to an adapter mounted on a compound bow, which has a cable bar attached thereto. Two embodiments of Specht's sling are taught, including one that can be used in over the shoulder carry and another which can be suspended from a person's belt. Attached to Specht's sling at only a single point, the bow tends to rotate during transport.

SUMMARY OF THE INVENTION

The subject invention is directed to improvements over applicant's prior teachings byway of a sling assembly which fits more closely to the bow, the improved sling assembly having a pair of small angular brackets that are mirror images of each other, each of the brackets having first and second arms which are disposed generally at an obtuse angle to each other and which define an open-ended notch and an elongated slot, respectively. The slot is sized to receive the sling and the notch to accommodate a weight adjustment screw, commonly employed in compound bows at the handle end of each limb. The notch is aligned generally parallel to the longitudinal centerline of the first arm. Together, the first and second arms of each bracket comprise means for rigidly attaching the bracket to the bow and means for connecting the sling to the bracket, respectively. The pair of brackets can be attached in such a way that the sling is disposed, alternatively, on one side or the other of the bow and ideally opposite the handedness of the archer.

In order to attach the brackets in the improved sling assembly to a bow, the weight adjustment screws need not be removed. Rather, each bracket is mounted on the bow by merely loosening one of the weight adjustment screws and then slipping the prongs of the first arm of the bracket around the screw between the proximate surface of the bow and a raised washer usually furnished with the screw. Each of the raised washers provides a tapered seat for receiving the weight adjustment screw inserted therein. Immediately prior to seating the screw, the longitudinal centerlines of the first arm and the proximate bow limb are aligned generally parallel to each other. Once the closed end of the notch abuts the shank of the screw, the screw is seated in the raised washer; and the first arm is simultaneously secured to the bow. The weight adjustment screw is then tightened to obtain a proper amount of tension on the bow using similar procedures to those employed when the bracket is not present. Moreover, a foam pad affixed to the underside of the first arm of each bracket is preferably provided to prevent the bracket, when it is mounted on the bow, from marring it.

Distal ends of the sling, when they are connected to the second arms of the brackets, are attached in such a way that the sling extends on the side of the bow opposite the line of sight, that is, away from any arrow positioned in the bow for firing. Further, the sling is preferably equipped with VELCRO fasteners that can be used, when the bow is fired, to hold the sling in a folded position, shortening its overall length so that it spans only the distance between attachment points of the weight adjustment screws.

In an alternative embodiment, the improved sling assembly also comprises a pair of small angular brackets that are mirror images of each other and have first and second arms which are disposed generally at an obtuse angle to each other. Rather than having an open-ended notch, the first arm defines a hole for receiving one of the weight adjustment screws, the hole having a radius slightly larger than the shank of the screw. As a consequence, the screw must be removed in order to attach the bracket to the bow.

DESCRIPTION OF THE PREFERRED EMBODIMENT

Figure 1:
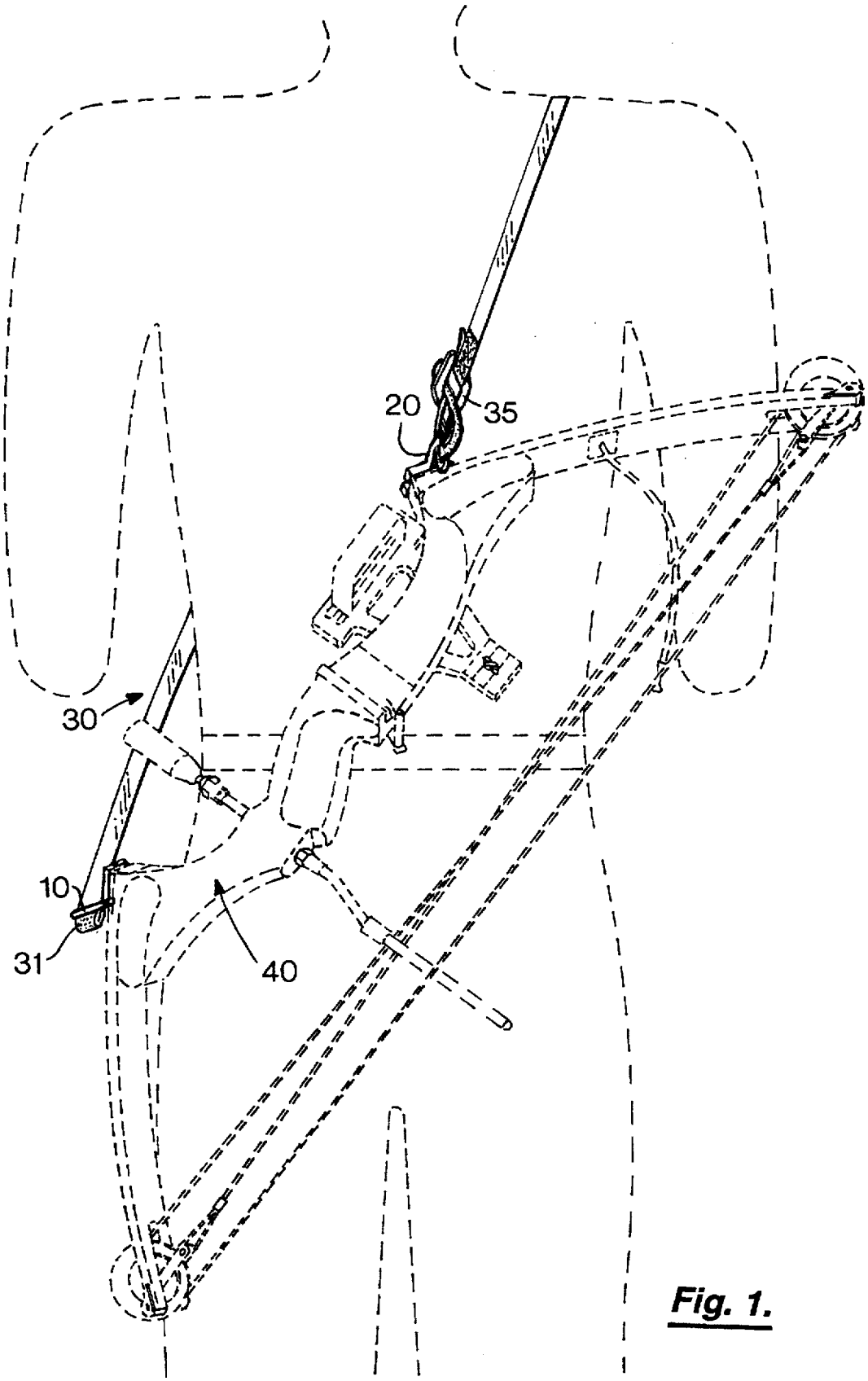
FIG. 1 is a perspective view of a compound bow with a sling assembly according to the present invention mounted thereon, the archer's body as well as conventional components of the bow being illustrated in dashed lines.
Figure 3:
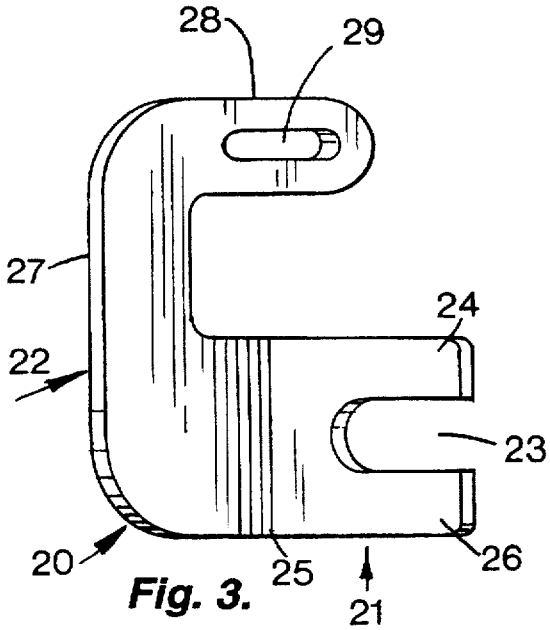
FIGS. 2 and 3 are perspective views, on an enlarged scale, of elements which comprise the lower and upper brackets, respectively, of the sling assembly according to FIG. 1 when the sling assembly is mounted for use by a right-handed archer.
Figure 2:
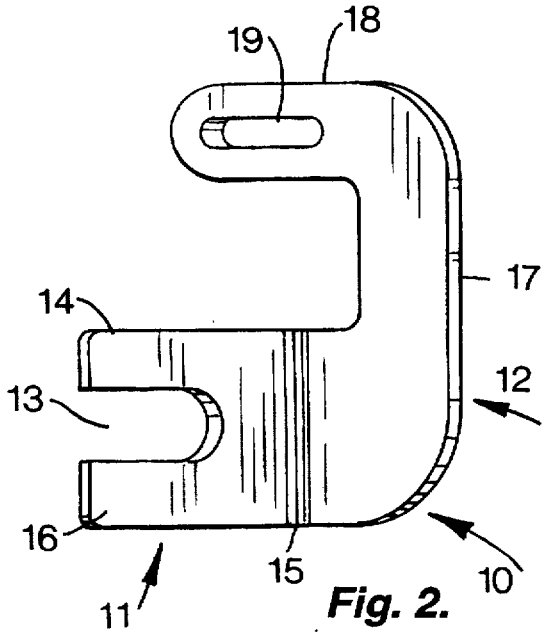

Referring now to FIGS. 1–6, a sling assembly comprising brackets 10, 20 and a sling 30 is removably mounted on a conventional compound bow 40. As is best seen in FIGS. 2 and 3, the brackets 10 and 20 are mirror images of each other, with elements in the bracket 20 being denoted by reference numerals which are greater by the number 10 than those reference numerals which denote corresponding elements in the bracket 10.

Formed from metal or, alternatively, from plastics of various thicknesses, the bracket 10 includes a first arm 11, a second arm 12, and a bend 15 connecting them. Similarly, the bracket 20 has first and second arms 21, 22 and a bend 25 formed of the same material as is the bracket 10. The brackets 10, 20 are preferably fabricated from ⅛ inch thick aluminum alloy material and can be made utilizing the same stamping die.

As illustrated in FIG. 2, the first arm 11 includes two prongs 14, 16 which define an open-ended, elongated notch 13. The notch 13 terminates in a closed end having a radius of curvature slightly larger than that of one of the weight adjustment screws 41. Distal from the closed end, each prong 14, 16 preferably terminates along an edge which is disposed generally perpendicularly to the notch 13.

Figure 4:
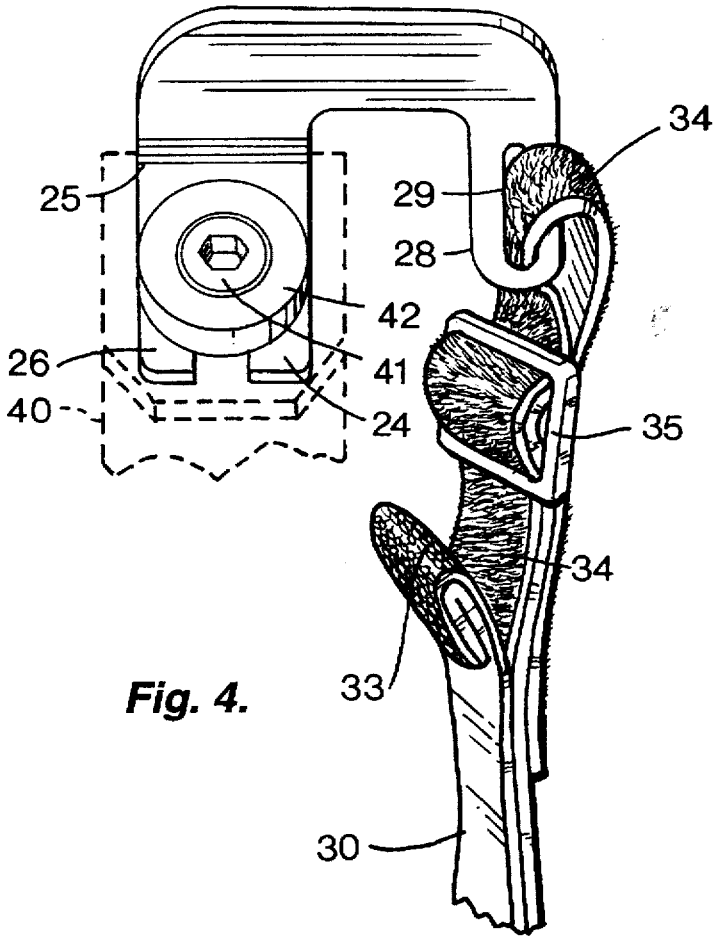
FIG. 4 is a frontal view, on an enlarged scale, of a fragmentary portion of the sling assembly according to FIG. 1.

As further illustrated in FIG. 3, the second arm 22 defines a slot 29 with closed ends. The slot 29 is sized to receive the sling 30 (FIG. 4). Oriented at an obtuse angle relative to the first arm 21, the second arm 22 is disposed roughly in the shape of a "U" which has a base 27 and a sling attachment branch 28, both of which lie generally in the same plane and are oriented perpendicularly to each other. The longitudinal centerlines of the elongated notch 23 and slot 29, on the other hand, are generally disposed in planes lying parallel to each other. Preferably, outside corners of the arm 22 are truncated and rounded; and junctures between the first arm 21 and the base 27 and between the base 27 and the branch 28 include fillets to eliminate any sharp inside corners. With respect to the bracket 10, its elements and their relationships can be described by substituting their respective reference numerals, as explained hereinabove, in the foregoing description.

Figure 5:
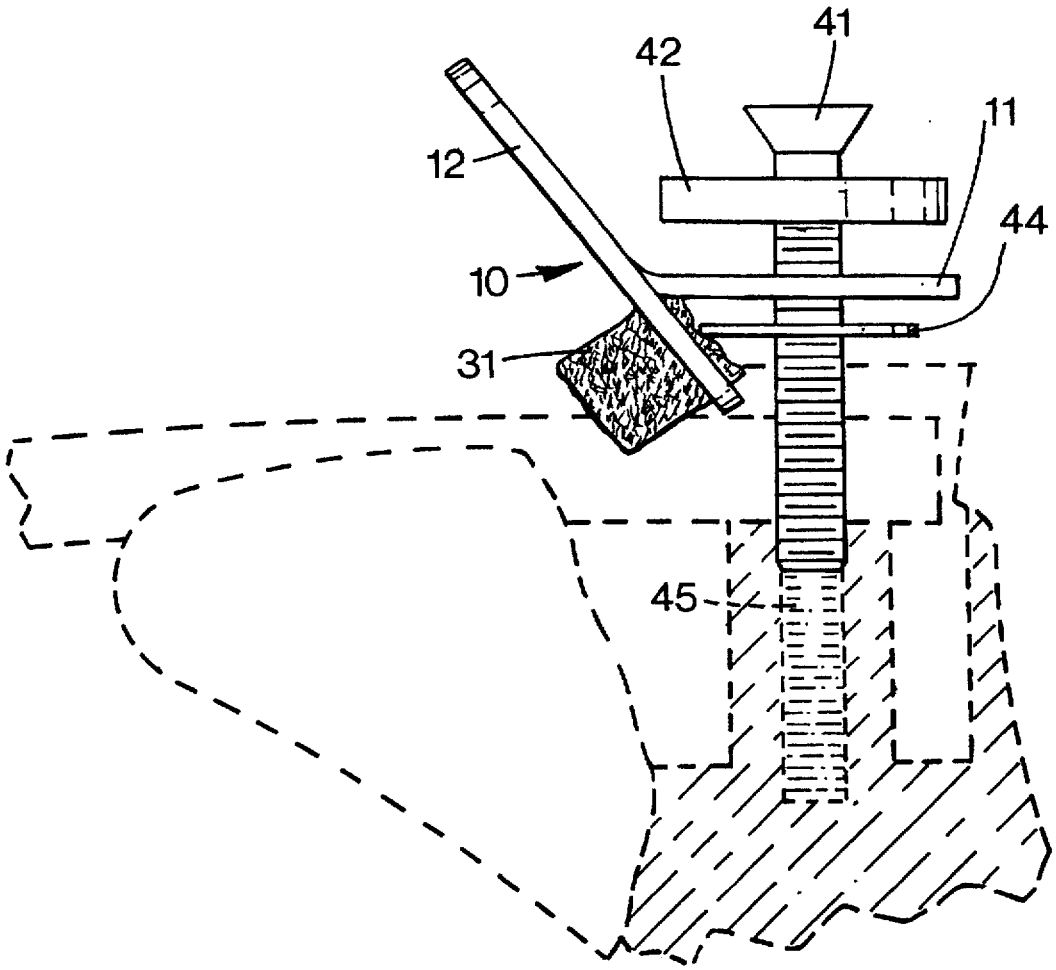
FIG. 5 is a side elevation view of a fragmentary portion of the sling assembly according to FIG. 1 and of a section of the bow to which the assembly is attached, the weight adjustment screw being shown in a loosened state and the bow being illustrated in dashed lines and partly in cross-section.

As is best seen in FIG. 5, a foam pad 44 is affixed to the underside of the bracket 10, 20. The foam pad 44 is employed to hold each of the arms 11, 21 in position once the sling assembly 10 has been mounted on the bow 40.

In preparation for mounting the brackets 10, 20 on the bow 40, its weight adjustment screws 41 and raised washers 42 must first be loosened; but they need not be removed (FIG. 5). Rather, each bracket 10, 20 is mounted on the bow 40 by slipping the first arm 11, 21 of the bracket around one of the loosened screws 41 and between the bow and the raised washer 42 held by the screw.

Figure 6:
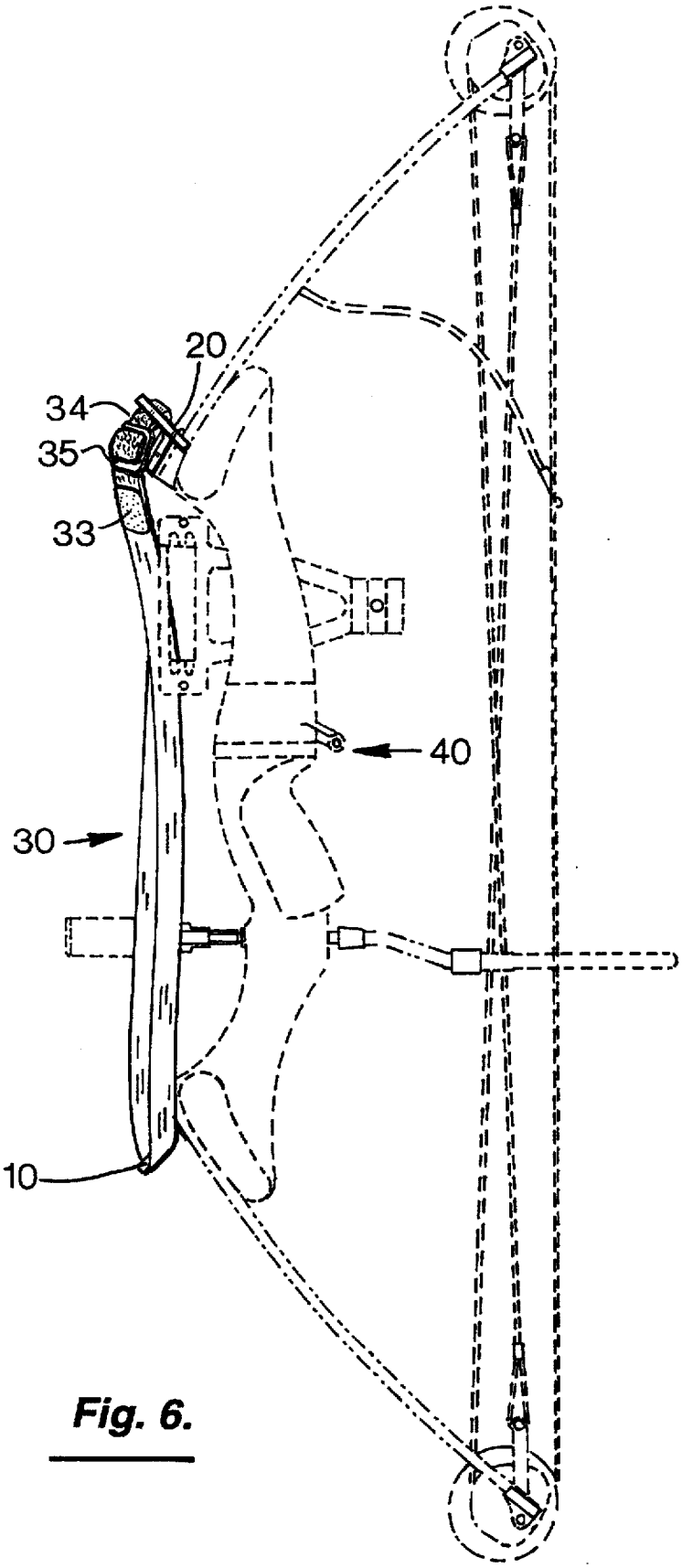
FIG. 6 is a side elevation view of the sling assembly according to FIG. 1 showing the sling being held out of the way by having it folded upon itself with its ends secured together.

In order to install the sling assembly on a bow 40 so that it can be used by a right-handed archer, one aligns the bracket 10 so that it can receive the lower weight adjustment screw 41 and positions the bracket 20 proximate with the upper weight adjustment screw (FIGS. 1 and 6). For use by a left-handed archer, one reverses the positions of the brackets 10, 20. In each case, the brackets 10, 20 are preferably positioned with the longitudinal centerlines of the first arm 11, 21 and the proximate bow limb aligned generally parallel to each other, thereby providing a more stable joint between the bow limbs and the brackets than would otherwise be produced.

Once the closed end of the notch 13 abuts the shank of the screw 41, the screw, threadedly engaged with the walls of a hole 45, is tightened sufficiently to secure the raised washer 42, the bracket 10, 20 and the bow 40 in assembled relation. The degree of tightening of the screws 41 determines how much tension is applied to the bow 40. To determine how much tightening of the screws 41 is best, one should follow procedures, commonly recommended by bow manufacturers for adjusting the tension on a compound bow.

Means for retaining distal ends of the sling 30 in the slots 19, 29 of the brackets 10, 20 when the strap is fully extended include a buckle 35 and a thickened end 31, respectively (FIG. 1). Moreover, distal ends of the sling 30 are preferably connected to the second arms 12, 22 of the brackets 10, 20 in such a way that the sling extends on the side of the bow 40 opposite the line of sight, that is, away from any arrow positioned in the bow for firing (FIG. 6). Further, the sling 30 is preferably equipped with VELCRO fasteners 33, 34 that can be used, when the bow 40 is fired, to hold the sling in a folded position, shortening its overall length so that it spans only the distance between attachment points of the weight adjustment screws 41. The hook and loop type fasteners 33, 34 can also be utilized to adjust the overall length of the sling 30 to facilitate carrying the bow 40.

The sling 30, which is preferably fabricated from a strap of flexible material, measures, by way of example, about 1 inch in width, 0.1 inch in thickness and 40 inches in length. The face of the hook and loop-type fastener 33 disposed proximate with the end 31 of the sling 30 is attachable to a mating surface of the fastener 34 situated near the opposite end of the sling, allowing the two ends to be removably affixed to each other.

The brackets 10, 20 are preferably employed to mount the sling assembly on a compound bow 40 since each bracket extends laterally only a very short distance from the surface of the bow. However, in some bows, an arrow quiver is so positioned that it would interfere with the placement of the sling if the mounting brackets 10, 20 were to be used. In such cases, brackets 50, 60 are provided.

Figure 8:
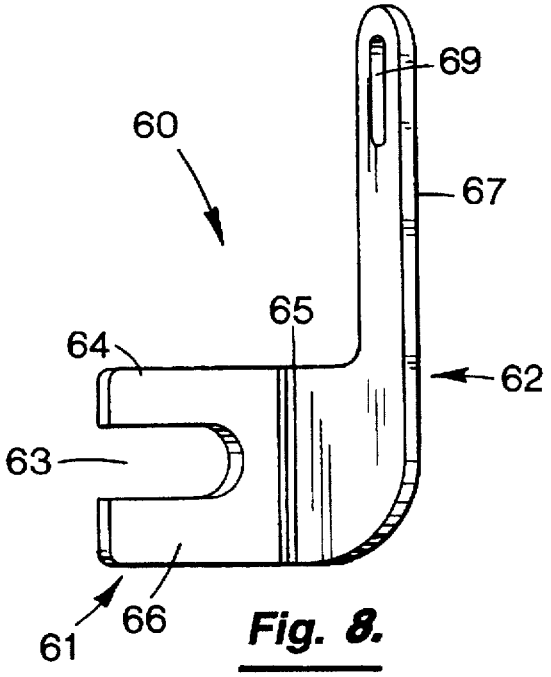
FIGS. 7 and 8 are perspective views, on an enlarged scale, of elements which comprise upper and lower brackets, respectively, of an alternative embodiment of the sling assembly according to the present invention, when the sling assembly is mounted for use by a right-handed archer.
Figure 7:
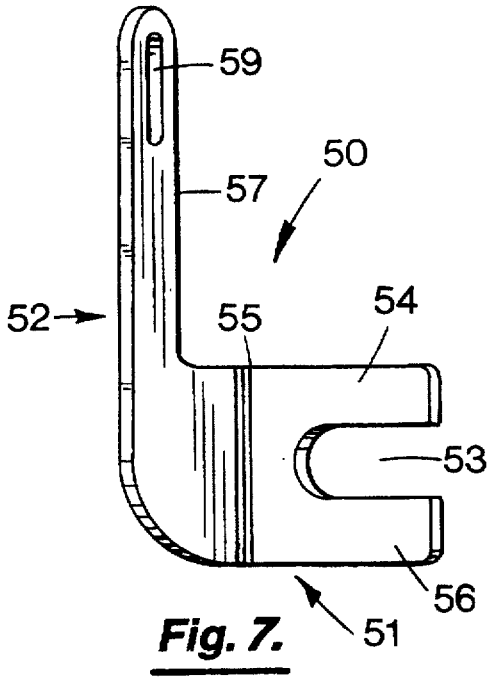
Figure 9:
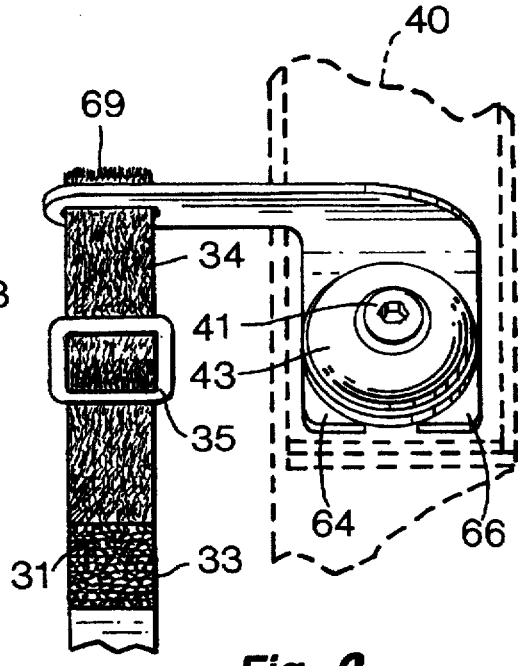

As illustrated in FIGS. 7–9, a sling assembly comprising brackets 50, 60 and a strap is removably mounted on a conventional compound bow 40. The brackets 50, 60 are preferably fabricated from ⅛ inch thick aluminum alloy material; but they can also be made out of a wide range of metals or even plastics of various thicknesses. The bracket 50 has a first arm 51, a second arm 52, and a bend 55 connecting the two arms. Moreover, the first arm 51 includes a pair of longitudinally extending prongs 54, 56 which define an open-ended notch 53 (FIG. 7). Oriented at an obtuse angle relative to the first arm 51, the second arm 52 includes an extension base 57 which defines an elongated slot 59, disposed distal from the notch 53, for receiving the sling 30.

As illustrated in FIGS. 7 and 8, the brackets 50, 60 are mirror images of each other. The difference between them is that the bends 55 and 65 are oriented in opposite directions. With respect to the bracket 60, its elements and their relationships can be described by substituting their reference numerals greater by the number 10 for the reference numerals of elements of the bracket 50 in the foregoing description.

Preferably, outside corners of the bracket 50 are truncated and rounded; and junctures between the first and second arms 51, 52, include fillets to eliminate any sharp inside corners.

Mounting the brackets 50, 60 on a compound bow 40 proceeds in a manner similar to that for mounting the brackets 10, 20. The weight adjustment screws 41 and raised washers 43 need not be removed. Rather, each bracket 50, 60 is mounted on the bow 40 by slipping the first arm 51, 61 of the bracket around one of the loosened screws 41 and between the bow and the raised washer 43 held by the screw. For use by a right-handed archer, one positions the brackets 50 and 60 so that each of them can receive the lower and upper weight adjustment screws 41, respectively. For use by a left-handed archer, one reverses the positions of the brackets 50, 60. In each case, the brackets 50, 60 are preferably positioned with the longitudinal centerlines of the first arm 51, 61 and the proximate bow limb aligned generally parallel to each other.

With the closed end of the notch 53, 63 abutting the shank of the screw 41, the screw, threadedly engaged with the walls of a hole formed in the bow 40, is tightened sufficiently to secure the raised washer 43, the bracket 50, 60 and the bow 40 in assembled relation. In tightening the screws 41, one should follow procedures, commonly recommended by bow manufacturers for adjusting the tension on a compound bow.

Figure 10:
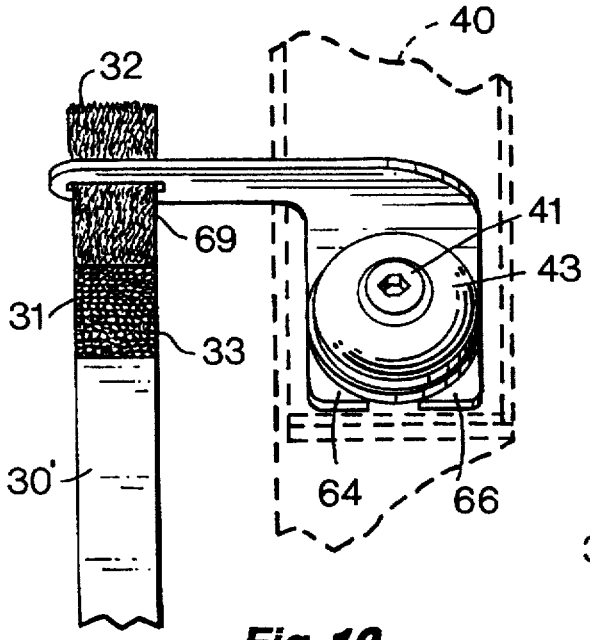
FIGS. 9 and 10 are frontal views of the bracket according to FIG. 8 and of a fragmentary portion of a sling secured thereto, alternative embodiments of an end of the sling being illustrated in FIGS. 9 and 10, respectively.

Also similarly to the brackets 10, 20, a sling 30 with a thickened end 31 and a buckle 35 can be used with the brackets 50, 60 (FIG. 9). Alternatively, a modified sling having a second thickened end 32 instead of the buckle 35 for securing the sling to the brackets 50, 60 can be utilized (FIG. 10). In each embodiment of the strap, one of the mating faces of hook and loop type fasteners 33, 34 is preferably disposed proximate each end of the sling to facilitate securing the two ends thereof together when the sling is folded upon itself.

Figure 12:
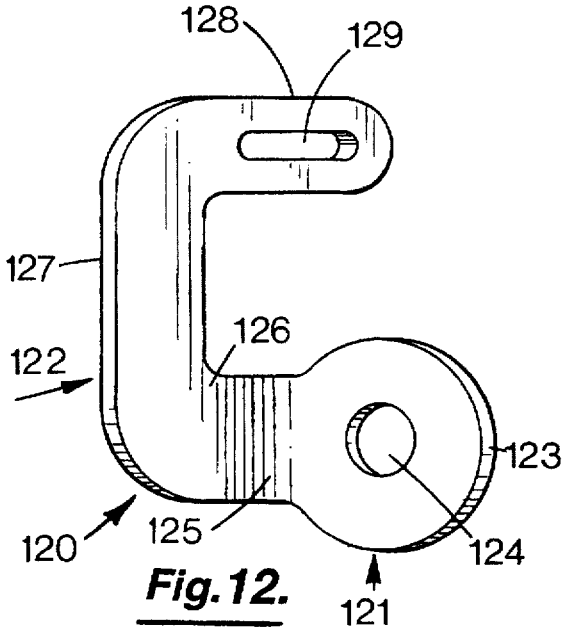
FIGS. 11 and 12 are perspective views, on an enlarged scale, of elements which comprise the lower and upper brackets, respectively, of an alternative embodiment of the sling assembly according to FIG. 1 when the sling assembly is mounted for use by a right-handed archer.
Figure 11:
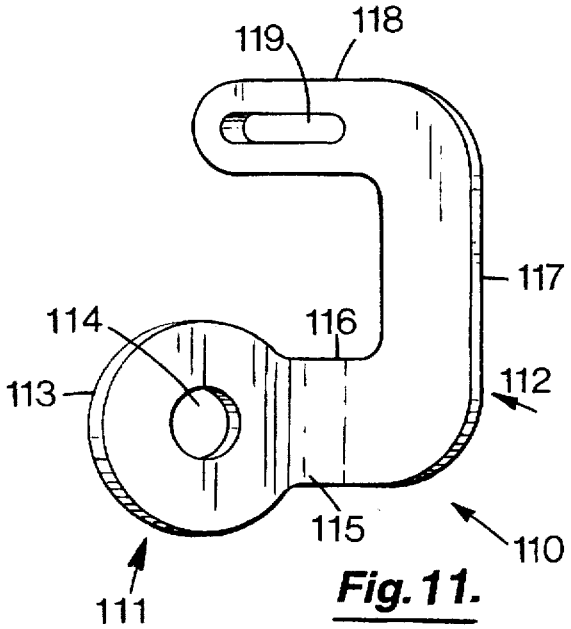
Figure 13:
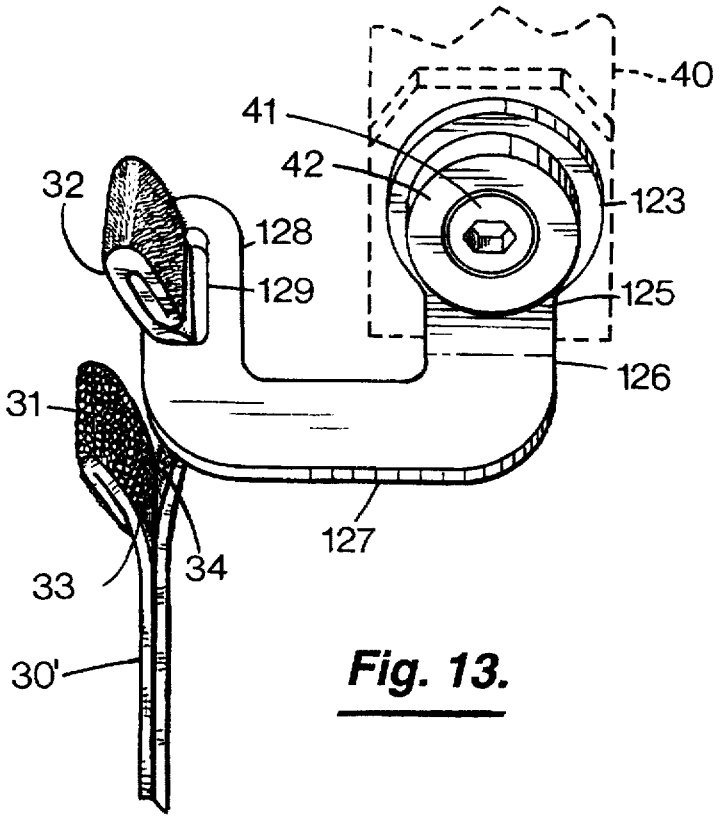
FIG. 13 is a frontal view, on an enlarged scale, of a fragmentary portion of an alternative embodiment of the sling assembly according to FIG. 1.

In a further alternative embodiment illustrated in FIGS. 11–13, a bracket 110 includes first and second arms 111, 112, the first arm defining a hole 114 and preferably terminating along a curved edge 113 which is concentric with the hole. Oriented at an obtuse angle relative to the first arm 111, the second arm 112 is disposed roughly in the shape of a "U" which has a neck 116, a base 117 and a sling attachment branch 118, all of which lie generally in the same plane. The branch 118 defines an elongated slot 119 for receiving the sling 30'. Situated proximate with a bend 115, the neck 116 and sling attachment branch 118 are oriented generally parallel to each other and at right angles to the base 117. Preferably, outside corners of the bracket 110 are truncated and rounded; and junctures between the neck 116 and the base 117 and between the base and the branch 118, as well as between the first and second arms 111, 112, include fillets to eliminate any sharp inside corners.

With respect to the bracket 120, its elements and their relationships can be described by substituting their respective reference numerals, which for each element is greater by 10 than for the corresponding element in the bracket 110, in the foregoing description.

In preparation for mounting the brackets 110, 120 on the bow 40, its weight adjustment screws 41, raised washers 42, and shim washers (not shown) must first be removed. One of the screws 41 is then inserted into a raised washer 42 and through the hole 114 in the first arm 111 of the bracket 110. Alternately, the screw 41 is inserted into a raised washer 42 and the bracket 120.

In order to install the brackets 110, 120 on a bow 40 so that the sling assembly can be used by a left-handed archer, one aligns the bracket 110 with a threaded hole formed in the bow 40 for receiving its upper weight adjustment screw 41 and positions the bracket 120 proximate with the lower weight adjustment screw (FIG. 13). For use by a right-handed archer, one reverses the positions of the brackets 110, 120. Each bracket 110, 120, when it is properly mounted, extends laterally only a very short distance from the surface of the bow.

To complete the mounting process, the screws 41 are threadedly engaged with the walls of holes formed in the bow 40 and tightened sufficiently to secure the washers 42, the brackets 110, 120 and the bow in assembled relation. Since the degree of tightening of the screws 41 determines how much tension is applied to the bow 40, one should follow procedures, commonly recommended by bow manufacturers for adjusting tension on a compound bow.

The sling 30', like the sling 30, is preferably fabricated from a flexible strap which measures, by way of example, about 1 inch in width, 0.1 inch in thickness and 40 inches in length. Inserted into the elongated slots 119, 129, the sling 30' includes thickened ends 31, 32 which prevent it from being pulled out of the slots 129, 119, respectively. Hook and loop type fasteners 33, 34 disposed proximate with the ends 31, 32, respectively, are provided to facilitate securing the two ends together so that the sling can be held in a folded position.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. A sling assembly for carrying a compound bow equipped with at least one removable weight adjustment screw, comprising:

(a) a pair of angular brackets, each bracket having first and second arms disposed generally at an angle to each other and extending generally laterally from each other, the first arm having a pair of longitudinally extending prongs which define a notch disposed therebetween, the notch having a transverse width which is slightly greater than the weight adjustment screw shank, so that the screw can be received between the pair of prongs;

(b) a sling;

(c) means, including the prongs in the first arm, for rigidly attaching each bracket to the bow; and (d) means, including the second arm of each bracket defining a slot through which the sling can be inserted, for connecting the sling to each of the brackets.

2. The sling assembly according to claim 1 in which the sling assembly further comprises means for keeping the sling to one side of the bow.

3. The sling assembly according to claim 1 which further comprises means for adjusting the sling with respect to its overall length.

* * * * *